US012313315B2

(12) United States Patent
Taras et al.

(10) Patent No.: US 12,313,315 B2
(45) Date of Patent: May 27, 2025

(54) REFRIGERANT LEAK MITIGATION FOR MULTI-CIRCUIT REFRIGERANT SYSTEMS

(71) Applicant: Goodman Manufacturing Company, L.P., Waller, TX (US)

(72) Inventors: Michael F. Taras, The Woodlands, TX (US); Zidu Ma, Cypress, TX (US); Russell C. Tharp, Houston, TX (US)

(73) Assignee: Goodman Manufacturing Company, L.P., Waller, TX (US)

( * ) Notice: Subject to any disclaimer, the term of this patent is extended or adjusted under 35 U.S.C. 154(b) by 28 days.

(21) Appl. No.: 17/654,892

(22) Filed: Mar. 15, 2022

(65) Prior Publication Data

US 2023/0296301 A1 Sep. 21, 2023

(51) Int. Cl.
*F25B 49/02* (2006.01)

(52) U.S. Cl.
CPC ..... *F25B 49/02* (2013.01); *F25B 2400/075* (2013.01); *F25B 2500/222* (2013.01); *F25B 2600/11* (2013.01); *F25B 2700/19* (2013.01); *F25B 2700/2103* (2013.01)

(58) Field of Classification Search
CPC ..... F25B 49/02; F25B 2400/075; F25B 2500/222; F25B 2600/11; F25B 2700/19; F25B 2700/2103
See application file for complete search history.

(56) References Cited

U.S. PATENT DOCUMENTS

2011/0131696 A1* 6/2011 Godshaw ..... A41D 13/00 2/24
2012/0011867 A1 1/2012 Koons et al.
2018/0283725 A1 10/2018 Ikawa et al.
2018/0347896 A1 12/2018 Eddy et al.
2021/0010704 A1* 1/2021 Kawashima ..... F24F 11/36

FOREIGN PATENT DOCUMENTS

EP 0411172 B1 * 1/1993 ..... F25D 17/02
JP H0914698 A * 10/2010 ..... F25B 39/04
JP 6257812 B2 1/2018

(Continued)

OTHER PUBLICATIONS

Shibata, Outdoor Machine of Air Conditioner, 1995, Full Document (Year: 1995).*

(Continued)

*Primary Examiner* — Nael N Babaa
(74) *Attorney, Agent, or Firm* — K&L Gates LLP

(57) ABSTRACT

The present disclosure relates to a multi-circuit heating, ventilation, and air conditioning ("HVAC") system for use with a first refrigerant in a first refrigerant circuit and a second refrigerant in a second refrigerant circuit. The second refrigerant circuit is fluidically isolated from the first refrigerant circuit. Additionally, a first sensor is operable to detect a leak of at least one of the first and second refrigerants or is operable to measure temperature or pressure from the first refrigerant circuit or the second refrigerant. The multi-circuit HVAC system further including a controller programmed to receive the measurement from the sensor to identify the circuit or circuits that are leaking, to turn off operation of the leaking circuit or circuits, and if only one circuit is leaking, operate only the other of the circuits.

19 Claims, 4 Drawing Sheets

(56) References Cited

FOREIGN PATENT DOCUMENTS

| | | | |
|---|---|---|---|
| KR | 0125739 | B1 | 4/1998 |
| KR | 100420717 | B1 * | 5/2001 |

OTHER PUBLICATIONS

Soo,Method for Detecting Leakage of Service Water Tube and Its System, 2001, Full Document (Year: 2001).*
Noya, "Refrigeration Device for a Plurality of Coolant Circuits" Full Document (Year: 1993).*
International Search Report and Written Opinion dated Jun. 23, 2023 for corresponding PCT Patent Application No. PCT/US2023/063001 filed on Feb. 22, 2023.

* cited by examiner

REFRIGERANT LEAK MITIGATION FOR MULTI-CIRCUIT REFRIGERANT SYSTEMS

BACKGROUND

This section is intended to introduce the reader to various aspects of the art that may be related to various aspects of the presently described embodiments—to help facilitate a better understanding of various aspects of the present embodiments. Accordingly, it should be understood that these statements are to be read in this light, and not as admissions of prior art.

In general, heating, ventilation, and air-conditioning ("HVAC") systems flow air over low-temperature (for cooling) or high-temperature (for heating) sources and into an indoor space, thereby adjusting an indoor space environment's air temperature and humidity. HVAC systems generate these low- and high-temperature sources by, among other techniques, taking advantage of a well-known physical principle: a fluid transitioning from gas to liquid releases heat, while a fluid transitioning from liquid to gas absorbs heat.

Within a typical HVAC system, a fluid refrigerant circulates through a closed loop circuit of tubing that uses one or more compressors and other flow-control devices to manipulate the refrigerant's flow and pressure, causing the refrigerant to cycle between the liquid and gas phases. Generally, these phase transitions occur within the HVAC's heat exchangers, which are part of the closed loop and are designed to transfer heat between the circulating refrigerant and flowing ambient air or another secondary fluid. As would be expected, the heat exchanger providing heating or cooling to the climate-controlled space or structure is described as being "indoor," and the heat exchanger transferring heat with the surrounding outdoor environment is described as being "outdoor."

HVAC systems may also include multiple refrigerant circuits (herein, "multi-circuit systems"), wherein an HVAC system has a plurality of "indoor" heat exchangers and a plurality of "outdoor" heat exchangers integrated into a single HVAC unit. In multi-circuit systems, a first refrigerant circuit is fluidically isolated from a second refrigerant circuit with regards to the refrigerants and thus separate compressors are used to circulate the refrigerant in each circuit. Other portions of the multi-circuit system may however be integrated or connected, for example each circuit may be controlled by a shared control system, shared footings or platforms may be used to supporting the plurality of heat exchangers, or the heat exchangers may be shared (e.g. heat being exchanged between one air stream and two refrigerant streams) although the refrigerants remain isolated in each circuit.

Regulatory restrictions on the use of certain refrigerants in HVAC and refrigeration systems have accelerated the effort of adapting moderate to low Global Warming Potential ("GWP") refrigerants which may be mildly flammable (e.g., A2L, A2, A3) as the replacement of high GWP refrigerants. For example, refrigerant R410A with a GWP of 2088 may be replaced with a A2L refrigerant such as R32 with a GWP of 675 or R-454B with a GWP of 466. Because moderate-to-low GWP refrigerants may be mildly flammable, new safety standards have been developed to guide the use of these mildly flammable refrigerants, which may pose a safety risk to building occupants due to asphyxiation, fire, and explosion. The current solution for detected leaks is to fully shut down the entire HVAC system until repairs can be made.

SUMMARY

Embodiments disclosed herein are directed to a multi-circuit HVAC system for use with a first refrigerant and a second refrigerant. The multi-circuit HVAC system includes a first refrigerant circuit for the first refrigerant that includes a first compressor, a first outdoor heat exchanger, a first expansion device, and a first indoor heat exchanger. Additionally, the multi-circuit HVAC system includes a second refrigerant circuit for the second refrigerant, the second refrigerant circuit being fluidically isolated from the first refrigerant circuit, and including a second compressor, a second outdoor heat exchanger, a second expansion device, and a second indoor heat exchanger. Additionally, a first sensor is operable to detect a leak of at least one of the first refrigerant from the first refrigerant circuit or the second refrigerant from the second refrigerant circuit or operable to measure temperature or pressure from the first refrigerant circuit or the second refrigerant. The multi-circuit HVAC system further including a controller programmed to receive the measurement from the sensor to identify the circuit or circuits that are leaking. The controller further programmed to turn off operation of the leaking circuit or circuits, and if only one circuit is leaking, operate only the other of the circuits.

Other embodiments disclosed herein are directed to a method of operating a multi-circuit HVAC system for use with a first refrigerant in a first refrigerant circuit and a second refrigerant in a second refrigerant circuit fluidically isolated from the first refrigerant circuit to condition an environment of a space. The method includes identifying, with a controller, whether the first refrigerant circuit, the second refrigerant circuit, or both is experiencing a leak of refrigerant based on measurements from at least one of a leak detector or a sensor measuring temperature or pressure. In addition, the method includes turning off operation of the leaking circuit or circuits, and if only one circuit is leaking, operating the other of the circuits.

Still other embodiments disclosed herein are directed to a controller for a multi-circuit HVAC system for use with a first refrigerant circuit and a second refrigerant circuit. The multi-circuit HVAC system includes a leak detector operable to detect a leak of at least one of a first refrigerant from the first refrigerant circuit or a second refrigerant from the second refrigerant circuit. The controller is programmed to determine whether the first refrigerant circuit, the second refrigerant circuit, or both is experiencing a leak of refrigerant based on measurements from at least one of a leak detector or a sensor measuring temperature or pressure. In addition, if a leak is detected, identify the circuit or circuits that are leaking, turn off operation of the leaking circuit or circuits; and if only one circuit is leaking, only operate the other of the circuits.

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

The following description relates to a HVAC system using moderate-to-low GWP value refrigerants, and more particularly to a method of detecting and mitigating refrigerant leaks in a HVAC system having multiple refrigeration circuits or loops. While an HVAC system is discussed, it should also be appreciated that the concepts are applicable to refrigeration systems as well.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION

Figure 1:
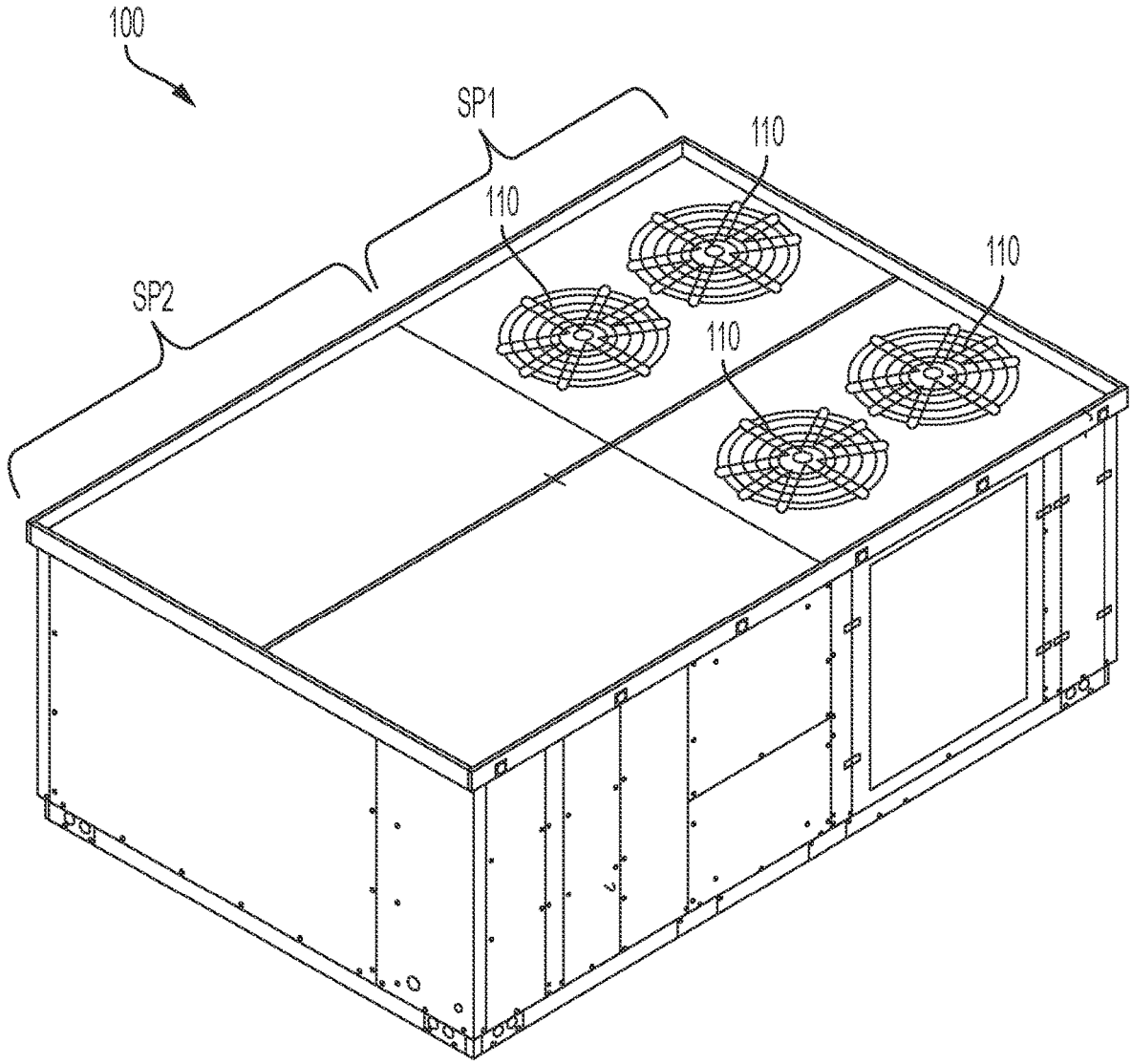
FIG. 1 is an isometric view of a HVAC system, according to one or more embodiments.

One or more specific embodiments of the present disclosure will be described below. In an effort to provide a concise description of these embodiments, not all features of an actual implementation may be described. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

The present disclosure relates to a multi-circuit HVAC system, and more particularly to a method of operating a multi-circuit HVAC system while detecting and mitigating refrigerant leaks. While a multi-circuit HVAC system is discussed, it should also be appreciated that the concepts are applicable to multi-circuit refrigeration systems as well. The present disclosure also relates to a multi-circuit HVAC system using moderate-to-low GWP value refrigerants.

While two refrigeration circuits are described, but it should be appreciated that the concepts are applicable to multi-circuit HVAC systems having three, four, five, or a greater number of refrigeration circuits. In multi-circuit systems, a first refrigerant circuit will be isolated from a second refrigerant circuit, and thus each refrigerant circuit may be independently operated. For example, a first refrigerant circuit could be off while a second refrigerant circuit is operating.

A first circuit of a multi-circuit HVAC system includes a compressor, an "outdoor" heat exchanger, an expansion device, and an "indoor" heat exchanger connected as components of a refrigerant circuit for the refrigerant. Another, or second, circuit of the multi-circuit HVAC system includes a second compressor, a second "outdoor" heat exchanger, a second expansion device, and a second "indoor" heat exchanger connected as components of a second refrigerant circuit for the refrigerant. As discussed further herein, some or all of the heat exchangers of the first refrigerant circuit may be shared with some or all of the heat exchangers of the second refrigerant circuit, while still maintaining fluid isolation between the refrigerants of the first and second circuits.

The multi-circuit HVAC system also includes a leak detection system for detecting a leak of the refrigerant from the refrigerant circuit(s). The leak detection system includes at least one leak detector, at least one thermocouple, and/or at least one pressure sensor placed along at least one or both of the first and second refrigerant circuits, and a controller, such as a programmable logic controller ("PLC"), more generally described herein as a "controller". The leak detector(s) may be placed to detect a leak of the refrigerant from either or both of the refrigerant circuits. For example, a leak detector may be placed within the fluid flow path of an enclosure, wherein the enclosure has an inlet, an outlet, and a fan operable to induce fluid flow along the fluid flow path. In addition, the temperature and/or pressure sensors may be positioned along one or more of the refrigeration circuits in a multi-circuit system. The controller of the leak detection system may connect to, monitor, and collect data from the leak detector, the temperature sensors, and the pressure sensors. In this manner, the controller is operable to receive a signal of the detection of a leak of a multi-circuit HVAC system, diagnose the location of the leak, and selectively control the multi-circuit HVAC system to maintain at least partial operation of the system. For example, if a refrigerant leak is detected on a first refrigerant circuit, while no refrigerant leak is detected on a second refrigerant circuit, the controller may turn off the compressor of the leaking circuit, while allowing the compressor of the second refrigerant circuit to remain operational.

Figure 2A:
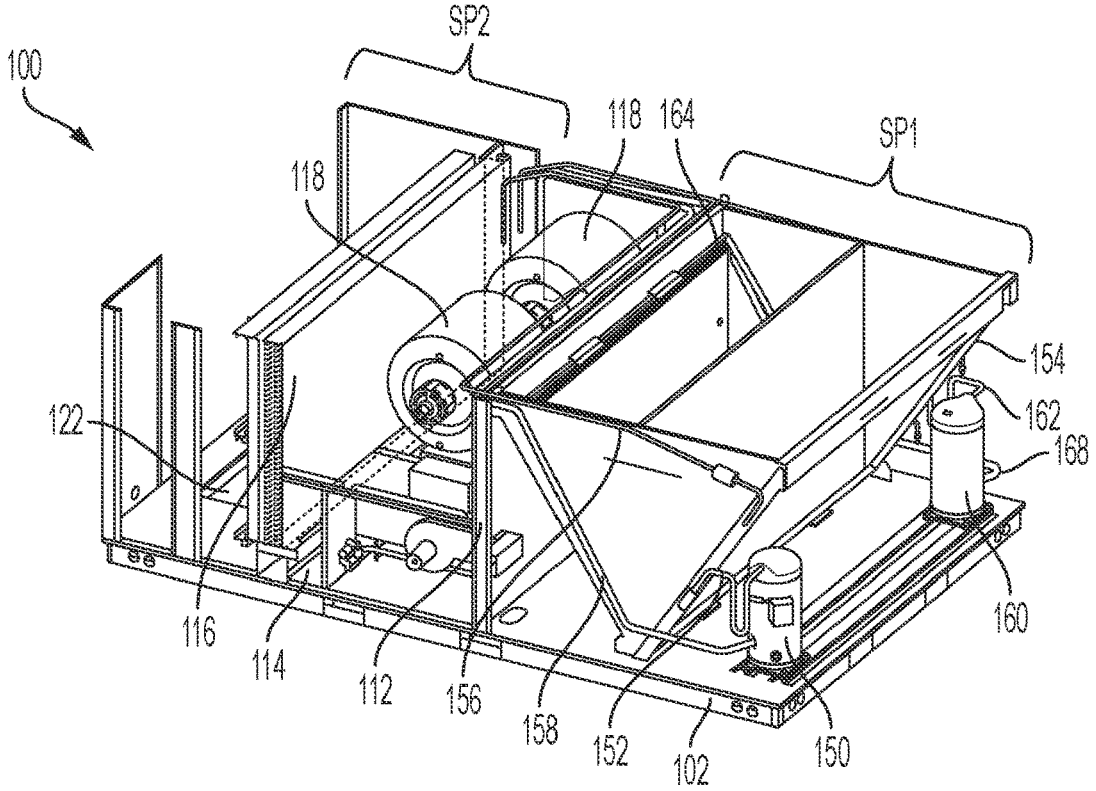
FIGS. 2A and 2B are partial isometric views of the HVAC system of FIG. 1, with some components removed for illustration.
Figure 2B:
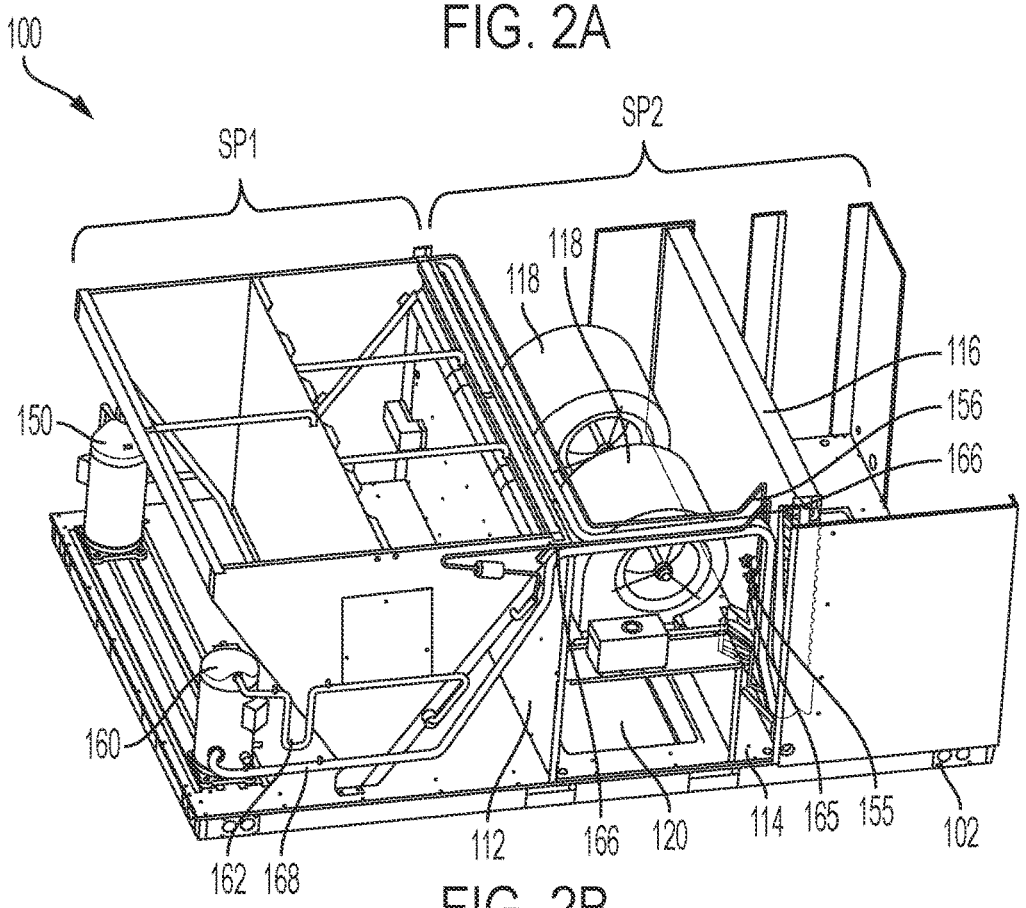
Figure 3:
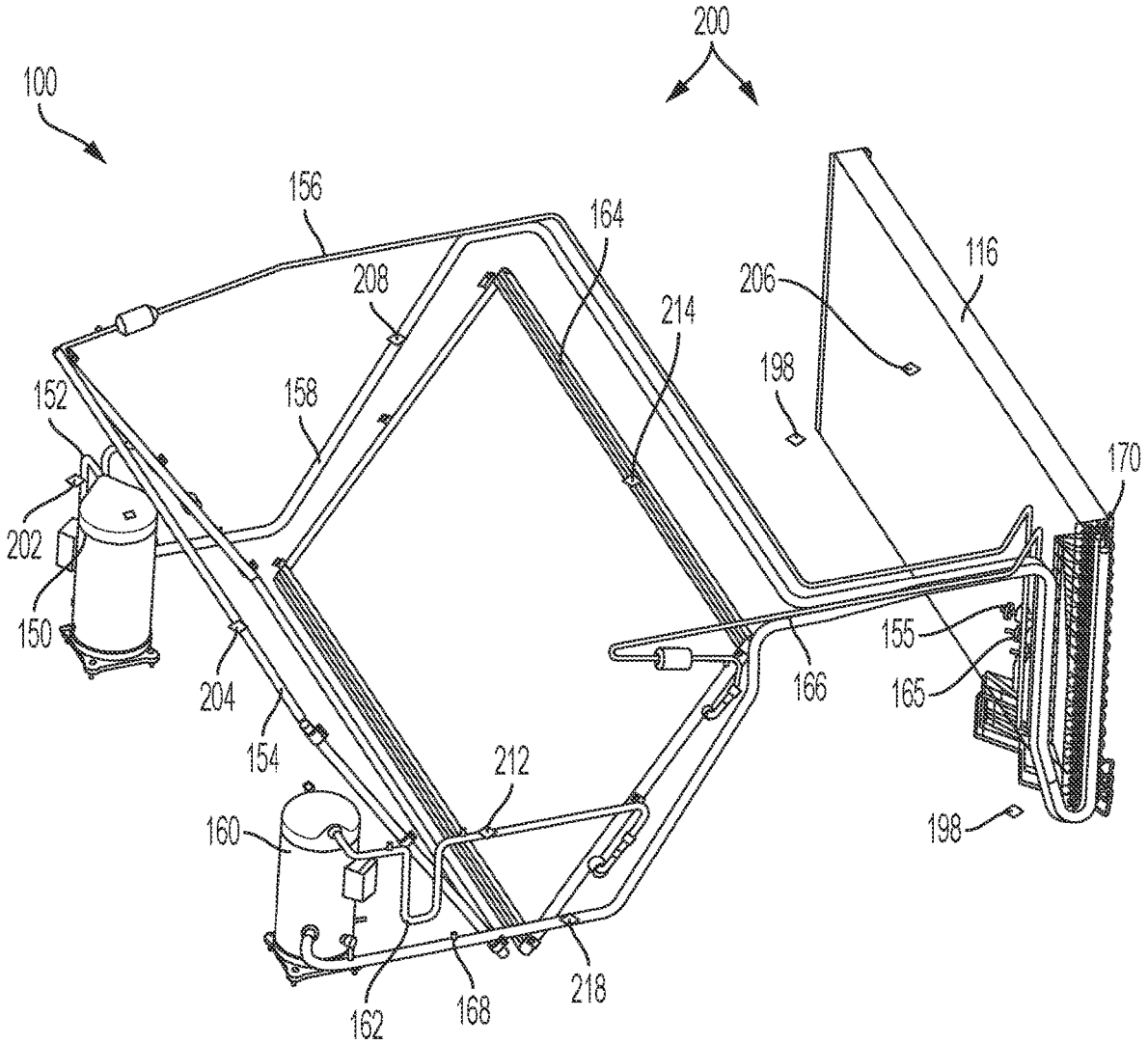
FIG. 3 is another partial isometric view of the HVAC system of FIG. 2B, with additional components removed for clarity, and a leak detection system in accordance with one or more embodiments.

Referring to FIGS. 1-3, an embodiment of a multi-circuit HVAC system 100 is shown. More particularly, the multi-circuit HVAC system 100 is shown in isometric and partial isometric views as seen from obliquely above the multi-circuit HVAC system 100. Although not shown in each FIGS. 2A and 2B, it should be appreciated that the multi-circuit HVAC system 100 includes additional components such as panel covers for covering and protecting the equipment of the multi-circuit HVAC system 100. The example multi-circuit HVAC system 100 is a so-called light commercial packaged rooftop unit and shall be described in terms of a cooling operation, although it should be appreciated that the multi-circuit HVAC system 100 could also be a heat pump and used for heating. Additionally, the multi-circuit HVAC system 100 may also represent residential packaged, residential split, light commercial split, or commercial applied applications as well as refrigeration system applications. The multi-circuit HVAC system 100 may be a variable refrigerant flow system with variable speed outdoor fans 110 and compressors (discussed below). As shown in FIGS. 1, 2A, and 2B, the multi-circuit HVAC system 100 includes both an "outdoor" section SP1 and an "indoor" section SP2 mounted on a common frame 102.

Referring to FIGS. 2A, 2B, and 3, the multi-circuit HVAC system 100 includes two refrigerant circuits, each of which is fluidly isolated from the other. Generally speaking, each refrigerant circuit circulates a refrigerant to perform a vapor compression refrigeration cycle, whereby heat is exchanged at an indoor heat exchanger within the indoor section SP2 and at one or more outdoor heat exchangers within the outdoor section SP1. In particular, the first refrigerant circuit includes a compressor 150, an outdoor heat exchanger 154, a bi-flow expansion device 155, an indoor heat exchanger 116, and a plurality of refrigerant lines extending therebetween. As best shown in FIG. 3, the first refrigerant circuit of the multi-circuit HVAC system 100 further includes a refrigerant line 152 extending from the high pressure side of the compressor 150 and extending to the outdoor heat exchanger 154, a line 156 extending between the bi-flow expansion device 155 and the indoor heat exchanger 116, and a refrigerant line 158 extending between the indoor heat exchanger 116 and the compressor 150. In addition, the second refrigerant circuit includes a compressor 160, an outdoor heat exchanger 164, a bi-flow expansion device 165, the indoor heat exchanger 116, and a plurality of refrigerant lines extending therebetween. As best shown in FIG. 3, the second refrigerant circuit of the multi-circuit HVAC system 100 includes a refrigerant line 162 extending from the high pressure side of the compressor 160 and extending to the outdoor heat exchanger 164, a refrigerant line 166 extending between the bi-flow expansion device 165 and the indoor heat exchanger 116, and a refrigerant line 168 extending between the indoor heat exchanger 116 and the compressor 160. As noted by the common reference numeral, the indoor heat exchanger 116 may be shared between the first and second refrigeration circuits, while still maintaining fluid isolation therebetween by having the refrigerants flow through separate tubes within the indoor heat exchanger 116. Similarly, the outdoor heat exchangers 154, 164 could also be combined into a single heat exchanger in other embodiments, or could be distributed into more than two heat exchangers, as discussed further below.

While not shown, each of the first and second refrigerant circuits can additionally include other HVAC system components, such as but not limited to accumulators, receivers, charge compensators, flow control devices, air movers, pumps, and filter driers secured within and attached to the structure of the multi-circuit HVAC system 100. For example, a four-way valve may be used to reverse the flow of refrigerant in each circuit to switch between a heating and cooling mode, and the filter drier may function to filter particulate contamination, copper shavings, and to capture any moisture present in the refrigerant circuit, thus drying the refrigerant.

Referring again to FIGS. 1-3, the outdoor section SP1 includes the two compressors 150, 160, which may be any suitable type. (e.g., fixed speed, two speed, variable speed, fixed volume, variable volume, etc.). In addition, the outdoor section SP1 includes four outdoor fans 110 that move air across the outdoor heat exchangers 154, 164 and to the outside of the multi-circuit HVAC system 100. The outdoor fans 110 may be any suitable type of fan, for example, a propeller fan. Although FIG. 1 shows two compressors 150, 160 and four outdoor fans 110, there may be more or fewer compressors 150, 160 or outdoor fans 110 uses as needed based on the particular multi-circuit HVAC system 100.

Referring to FIGS. 2A and 2B, the outdoor heat exchangers 154, 164 are shown arranged in a V-shape with the bottom portions approaching one another near the frame 102, however the heat exchangers can be arranged in any configuration. Also, the heat exchangers 154, 164 are also shown as planar, but other embodiments may alternatively use curved forms (e.g., bent in an arc or other shape). The outdoor heat exchangers 154, 164 may each include a plurality of heat-transfer tubes through which a refrigerant flows and a plurality of heat-transfer fins in which air flows between gaps thereof. The plurality of heat-transfer tubes may be arranged in an up-down direction (hereunder may be referred to as "row direction"), and each heat-transfer tube may extend in a direction substantially orthogonal to the up-down direction (in a substantially horizontal direction). At an end portion of the outdoor heat exchangers 154, 164, for example, the heat-transfer tubes are connected to each other by being bent into a U-shape or by using a U-shaped return bends so that the flow of a refrigerant from a certain column to another column and/or a certain row to another row is turned back. Also, a plurality of heat-transfer fins may also extend so as to be oriented in the up-down direction and arranged side by side with a predetermined interval between the plurality of heat-transfer fins. The plurality of heat-transfer fins and the plurality of heat-transfer tubes are assembled to each other so that each heat-transfer fin extends through the plurality of heat-transfer tubes. The plurality of heat-transfer fins may also be disposed in a plurality of columns. Although the outdoor heat exchangers 154, 164 are described as a round tube and plate fin heat exchangers, other heat exchanger types, such as for instance microchannel heat exchangers, are also within the scope of the disclosure. Although FIGS. 2A and 2B show two outdoor heat exchangers 154, 164, there may be more or fewer outdoor heat exchangers 154, 164 as needed based on the particular multi-circuit HVAC system 100. For example, it is anticipated that outdoor heat exchangers 154, 164 could be combined into a single heat exchanger by layering or stacking the plurality of heat-transfer tubes from the outdoor each exchanger 154 on top of the heat-transfer tubes from the outdoor heat exchanger 164. This layering or stacking could alternate rows for the tubes from each heat exchanger 154, 164 or could sequentially stack all of the tubes from one heat exchanger on top of all of the tubes for the second heat exchanger.

Due to the structure of the outdoor heat exchangers 154, 164, operation of the outdoor fans 110 draws a flow path of outdoor air into the outdoor section SP1 and passes through the outdoor heat exchangers 154, 164. As the outdoor air passes through the outdoor heat exchangers, 154, 164, the outdoor air exchanges thermal energy with the refrigerants that flow in the first and second refrigerant circuits through the outdoor heat exchangers 154, 164. After the thermal energy exchange in the outdoor heat exchangers 154, 164, the air is then also discharged to the outside of the outdoor section SP1 by the outdoor fans 110.

The outdoor section SP1 is separated from the indoor section SP2 by a partition plate 112. Outdoor air flows to the outdoor section SP1 and indoor air from the structure or environment being cooled or heated flows to the indoor section SP2. In an ordinary state, the indoor air and the outdoor air do not mix and do not communicate with each other within or via the multi-circuit HVAC system 100. It is noted that there optionally exist airside economizers that allow mixing indoor and outdoor air, however such economizers are not reviewed in relation to this discussion. The outdoor section SP1 also includes the bi-flow expansion devices 155, 165 for expansion of the refrigerant from a high pressure to low pressure, for example, a thermostatic expansion valve ("TXV") or electronic expansion valve ("EXV"). The bi-flow expansion devices 155, 165 may alternatively be located in the indoor section SP2 or each of them replaced by a pair of directional expansion devices and associated internal or external check valves.

The indoor section SP2 also includes the indoor heat exchanger 116 and the indoor blowers 118, which may be, for example, a centrifugal fan. Although FIGS. 2A and 2B show one indoor heat exchanger 116, there may be more indoor heat exchangers used as needed for the particular multi-circuit HVAC system 100. Also, as described previously for the outdoor heat exchangers 154, 164, any arrangement of heat transfer tubes may be used when combining heat exchangers 154, 164 into a single heat exchanger. In this embodiment, the heat transfer tubes of the first refrigerant circuit and the heat transfer tubes of the second refrigerant circuit are stacked in an alternating pattern. (e.g., each heat transfer tube of the first refrigerant circuit is sandwiched between a pair of heat transfer tubes of the second refrigerant circuit). In addition, as best shown in FIG. 3, the indoor heat exchanger 116 may also include a manifold 170 along each end which is used to route the refrigerants of the first and second circuits, while still maintaining fluid isolation therebetween. In particular, for each refrigerant circuit, the manifold 170 uses a series of U-shaped return bends so that the flow of the refrigerant from a certain column to another column and/or a certain row to another row is turned back and thus remains isolated within the first or the second refrigerant circuit. In addition, other arrangement of heat transfer tubes may be used, such as sequentially stacking, wherein all of the heat transfer tubes of the first refrigerant circuit would be stacking adjacent to one another, while all of the heat transfer tubes of the second refrigerant circuit would be stacking adjacent to one another.

Referring still to FIGS. 2A and 2B, the indoor heat exchanger 116 divides the indoor section SP2 into a space on an upstream side with respect to the indoor heat exchanger 116 and a space on a downstream side with respect to the indoor heat exchanger 116. Air that flows to the downstream side from the upstream side with respect to the indoor heat exchanger 116 passes through the indoor heat exchanger 116. The blowers 118 are disposed in the space on the downstream side with respect to the indoor heat exchanger 116 and generates an airflow that passes through the indoor heat exchanger 116. A supply air duct (not shown) may attach to the supply air opening 120 through a bottom plate 114 in the bottom of the multi-circuit HVAC system 100 (note that the side air supply and discharge are also feasible). Alternatively, horizontal, instead of downward, supply and return air ducts can be provided, and the down-shot air duct configurations are also within the scope of the disclosure. The blowers 118 are disposed above the supply air opening 120 for providing supply air to the indoor space or environment being conditioned. The multi-circuit HVAC system 100 may draw in ambient air to be conditioned and/or the bottom plate 114 may also include a return air opening 122 that provides return air from the indoor space being conditioned to either flow through the indoor heat exchanger 116 and the blowers 118 again or be expelled to the outside environment.

During operation, the first refrigerant and second refrigerant circuits operate on similar principles, and thus the operation of only the first refrigerant circuit is described in the interest of brevity. When operating to cool the indoor air, the first refrigerant is compressed by the compressor 150 and is sent to the outdoor heat exchanger 154. The refrigerant exchanges thermal energy with outdoor air at the outdoor heat exchanger 154 and is then sent to the bi-flow expansion device 155. At the bi-flow expansion device 155 the refrigerant expands and its pressure and temperature are reduced. The refrigerant then flows to the indoor heat exchanger 116, where the low temperature, low-pressure refrigerant exchanges thermal energy with the ambient and/or return air. The ambient/return air is cooled by having thermal energy absorbed by the refrigerant in the indoor heat exchanger 116 and is supplied to the indoor space or environment being conditioned. The vapor refrigerant after the heat exchange at the indoor heat exchanger 116 is then sucked into the compressor 150 to repeat the cycle. In addition, the first and second refrigeration circuits may also be individually configured as heat pumps in some embodiments, whereby a four-way valve or reversing valve (not shown) may be used to reverse the flow of refrigerant, thus allowing thermal energy from outside air (or source such as water, soil, etc.) to be transferred into the outdoor heat exchanger 154 and then transferred indoors via the indoor heat exchanger 116.

Referring to FIG. 3, the multi-circuit HVAC system 100 is shown with additional components removed for clarity. As shown, the multi-circuit HVAC system 100 also includes a leak detection system 200 in accordance with one or more embodiments. Generally speaking, the leak detection system 200 detects a refrigerant leak from the multi-circuit HVAC system 100. The leak detection system 200 is thus able to determine the presence of a refrigerant leak in the system as well as determine which, or if both, of the refrigerant circuits is leaking. The control system then determines if both or if only one of the refrigerant circuits should be shut down. If only one of the refrigerant circuits is leaking, then the control system can also determine whether to continue to operate the non-leaking refrigerant circuit or possibly to operate the non-leaking circuit in a partial-load mode by reducing the indoor air flow to minimum required flow rate determined by the safety standards or about 60 to 75% of that at full-load operation. The control system may also determine if the indoor blower(s), and possibly other supporting equipment, should continue to operate when a leak is detected. Such leak detection systems may be used with any refrigerant, but may be particularly useful for systems using moderate-to-low GWP refrigerants which are mildly flammable (e.g., such as A2L, A2, A3). Thus as described below, the leak detection system 200 of the multi-circuit HVAC system 100 may be operable to satisfy safety regulations imposed for moderate-to-low GWP refrigerants, and may mitigate risks associated with occupant exposure to asphyxiation, fire, and explosion, while also maintaining at least partial-load operation of the multi-circuit HVAC system 100 when a refrigerant leak is detected in only one of the refrigerant circuits.

Referring still to FIG. 3, the leak detection system 200 of the multi-circuit HVAC system 100 includes the leak detector 198 that detects the presence of a refrigerant outside of the first or second refrigerant circuits. In addition, the leak detection system 200 may include a plurality of sensors to measure at least one of temperature or pressure along various positions within the first refrigerant circuit. In the embodiment of FIG. 3 for example, the plurality of sensors includes temperature or pressure sensors 202, 204, 206, 208. The sensors 202, 208 are placed along the refrigerant lines 152, 158, respectively, the sensor 204 is placed on the outdoor heat exchanger 154, and the sensor 206 is placed on the indoor heat exchanger 116.

Similarly, the multi-circuit HVAC system 100 may also include additional sensors to measure at least one of temperature or pressure along various other positions within the second refrigerant circuit. As shown in FIG. 3, the multi-circuit HVAC system 100 includes temperature or pressure sensors 212, 214, 218. The sensors 212, 218 are placed along the refrigerant lines 162, 168, respectively, and the sensor 214 is placed on the outdoor heat exchanger 164. Since the indoor heat exchanger 116 includes both the first and second refrigerant circuits, the sensor 206 on the indoor heat exchanger 116 is shared between the first and the second refrigerant circuits in this embodiment. However, a separate temperature or pressure sensor (not shown) could also be used in other embodiments. For example, if the first and second refrigerant circuits each used a separate indoor heat exchanger, a separate temperature or pressure sensor could be used to measure each indoor heat exchanger.

Additionally, the multi-circuit HVAC system 100 may further include one or more leak detectors 198 which may be positioned proximate to the indoor heat exchanger 116, near of the bottom of the base pan, on the drain pan, nearby an air filter, and near or within the air flow path of the indoor blowers 118 (FIG. 2B) of both the first and second refrigerant circuits. As described, some embodiments may use a single indoor heat exchanger 116 for both the first and second refrigerant circuits and thus the position of the leak detectors 198 may be operable to detect a leak from either or both of the first and second refrigerant circuits.

Figure 4:
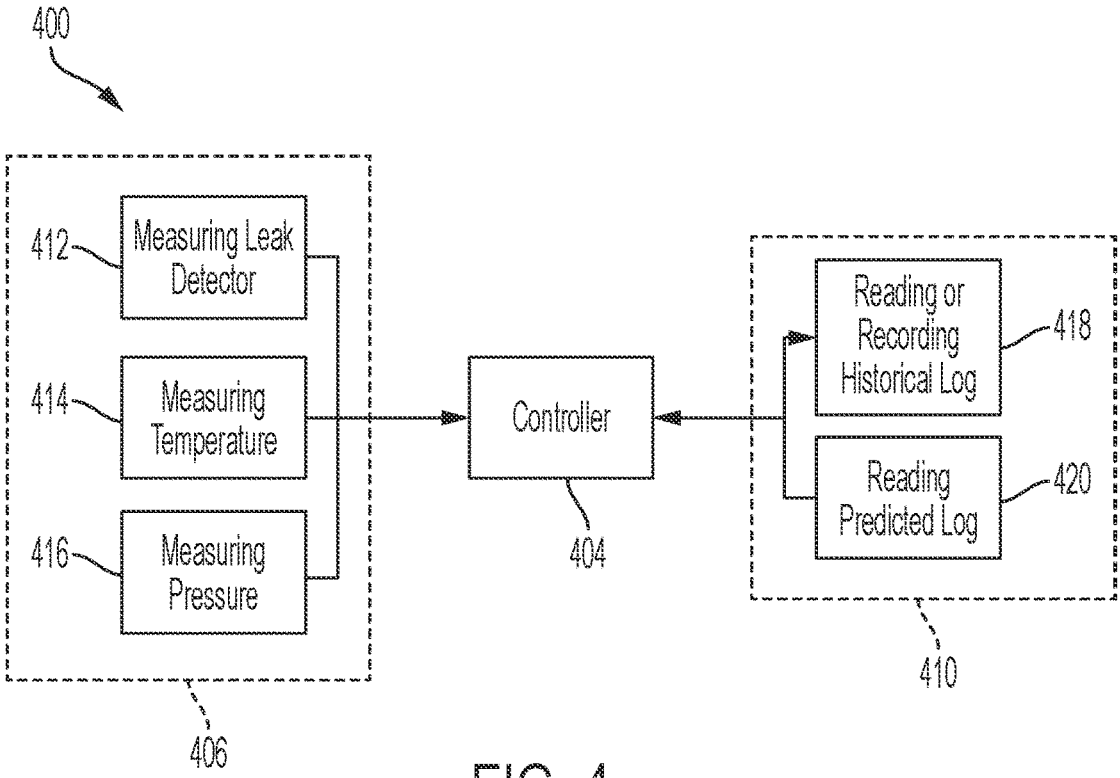
FIG. 4 is a schematic diagram illustrating a data flow and function of a leak detection system in accordance with one or more embodiments.

Referring to FIGS. 3 and 4, during operations of the multi-circuit HVAC system 100, a controller 404 is in communication with and receives HVAC system measurements 406 including measurements 412 from the leak detectors 198. A first of the leak detectors 198 is positioned to detect a refrigerant leak from the first refrigerant circuit or the second refrigerant circuit and a second of the leak detectors 198 is positioned to detect a refrigerant leak from the second refrigerant or the first refrigerant circuit. The controller 404 determines which of the two circuits has the refrigerant leak, if both circuits are leaking, or if both circuits are not leaking. For example, if the controller 404 determines there is a refrigerant leak of only in the first refrigerant circuit, then the controller 404 may selectively turn off the compressor 150 of the first refrigerant circuit, while allowing the compressor 160 of the second refrigerant circuit to remain operational. Alternatively, the compressor 160 could be set to a partial-load mode. In this manner, the comfort within the indoor space or environment conditioned by the multi-circuit HVAC system 100 could be less impacted as compared to fully shutting down both of the first and second refrigeration circuits of the multi-circuit HVAC system 100.

Optionally, the HVAC system measurements 406 may further include temperature measurements 414 and/or pressure measurements 416 from sensors 202, 204, 206, 208, 212, 214, 218, that monitor the performance of the first and second refrigerant circuits during operation. As described below, the measurements from the leak detectors 198 and the sensors 202, 204, 206, 208, 212, 214, 218 may be used to detecting a leak, determining which refrigerant circuit is leaking, and to determining a leak location along the first and second refrigerant circuits.

The controller 404 is also in communication with a database 410 to store the HVAC system measurements 406 and to retrieve previously stored values from the database 410. When the controller 404 communicates with the database 410, the temperate and/or pressure measurements from the sensors may be recorded and stored for future use. In particular, the database 410 may include a historical log 418 for recording performance data and system conditions for each refrigerant circuit. The historical log 418 stores raw measurements, measurements which have been averaged overtime, or any combinations thereof. In addition, the historical log includes HVAC system measurements 406 at different operating conditions (e.g., during a heating mode, during cooling mode, at a partial-load mode, at a full-load mode, etc.). Thus, the historical log 418 establishes an expected range of temperatures and/or pressures for different operating conditions. The database 410 may also store predicted operational values 420 that includes predicted operation and performance data for each refrigerant circuit using calculated or otherwise predetermined values.

The controller 404 may use the leak detector measurements 412 by themselves to directly detect a refrigerant leak, whether occurring in either or both of the refrigerant circuits, and use the detection as an initial trigger to begin measuring temperature 414 and/or pressure 416. For example, a refrigerant measurement by the leak detector 198 may be used as an initial trigger to compare the measured temperatures 414 and/or pressures 416 to the stored values in the database 410 as described below. Thus in some embodiments, the leak detector measurements 412 may trigger the controller 404 to determine the source of the leak as coming from one or both of the refrigerant circuits. Alternatively, as discussed below, other embodiments may not use the leak detector 198 as an initial trigger, or may not use leak detector 198 at all, and may simply use changes in the other HVAC system measurements 406 to indicate a refrigerant system leak.

Independent of any particular leak detection or triggering method, the determination of the leak source may occur by a comparison of currently measured temperatures 414 and pressures 416 to the historical log 418 or to the predicted operational values 420. In either comparison, values or sharp gradients with respect to time outside of a predefined range are used to indicate a refrigerant leak. By performing comparisons of the measured data with either historical or predicted data for both the first and second refrigerant circuits to determine which, or if both, of the circuits' measured data is outside a predefined range, the controller 404 determines which of the two circuits has the refrigerant leak, if both circuits are leaking, or if both circuits are not leaking.

Additionally, or alternatively, if the first and the second refrigerant circuits are performing in the same operational mode (e.g., both in heating or cooling), then the HVAC measurements 406 of refrigerant first circuit may be compared to the HVAC measurements 406 of the second refrigerant circuit. For example, if both the first and the second refrigerant circuits are operating in a cooling mode, the controller 404 could compare the temperature of the refrigerants returning to the compressors 150, 160 with sensors 208 and 218. In this example, the lower temperature would indicate the refrigerant circuit with the leak. Alternatively, if the sensors 208 and 218 are instead configured to measure pressure, the lower pressure would identify the leaking circuit.

The controller 404 could also make similar comparisons between the first and the second refrigerant circuits using measurements made with sensors placed along other portions of the circuits. For example, the controller 404 could compare the temperature or pressure measurements from the sensor 202 of the first refrigerant circuit to the temperature or pressure measurement from the sensor 212 of the second refrigerant circuit, each of which is downstream from the compressors 150, 160. In this example, the circuit having the lowest temperature or pressure may again indicate which circuit is lower on refrigerant and thus may identify which circuit has a refrigerant leak.

Alternatively, it may be desirable in some embodiments to only measure temperatures and or pressures from one of the refrigerant circuits (e.g., via sensors 202, 204, 206, 208 of the first refrigerant circuit), while not collecting measurements on the second refrigerant circuit (e.g., via sensors 212, 214, 218), otherwise also referred to as the "un-instrumented" refrigerant circuit. Such configurations could present a cost savings as fewer sensors would be required, the controller 404 would need fewer data channels and less processing power, and the database 410 could be smaller. Generally speaking, in such embodiments, the leaking circuit could be determined by the controller 404 by using process of elimination. More specifically, the controller 404 could receive measurements 412 from the leak detector 198, and the location of the leak detector 198 could be selected such that it could detect a refrigerant leak from either of the first or second refrigerant circuit. The controller 404 could then compare the currently measured temperatures 414 and or pressures 416 of the first refrigerant circuit against either the historical log 418 or to the predicted operational values 420, to determine if the first refrigerant circuit is low on refrigerant and thus is potentially leaking. For example, if the temperature 414 and or pressure 416 measured by the sensor 208 downstream of the indoor heat exchanger 116 is lower than the expected value in either the historical log 418 or the predicted operational values 420, then the first refrigerant circuit may be low on refrigerant, and thus is leaking.

When the first refrigerant circuit is leaking, the controller 404 turns off the compressor 150 of the first refrigerant circuit, while allowing the compressor 160 of the second refrigerant circuit to remain operational. However, if the first refrigerant circuit indicates no leak, then by process of elimination, the leak detected by the leak detector 198 originated from the un-instrumented second refrigerant circuit. In this case, the compressor 160 of the second refrigerant circuit would be turned off, while allowing the compressor 150 of the first refrigerant circuit to remain operational. It should be appreciated that alternatively, the second refrigeration circuit may be monitored and the first refrigeration circuit could be the un-instrumented circuit.

Also in the previous example the controller 404 can also determine when both the instrumented first refrigerant circuit and the un-instrumented" second refrigerant circuit has a leak. The leak detector 198 would again be placed so that it can measure a refrigerant leak from both the first and second refrigerant circuit. The controller 404 would again compare the currently measured temperatures 414 and or pressures 416 of the first refrigerant circuit against either the historical log 418 or to the predicted operational values 420. If the first refrigerant circuit is low on refrigerant and thus potentially leaking, the measured temperature 414 and/or pressure 416 will be lower than the expected value in either the historical log 418 or the predicted operational values 420. In this instance, the first refrigerant circuit is potentially leaking, the controller 404 turns off the compressor 150 of the first refrigerant circuit, and the compressor 160 of the second refrigerant circuit to remain operational. However, if the second refrigerant circuit is also leaking, the leak detector 198 will continue to measure leaking refrigerant, and the controller 404 will then turn off the compressor 160 of the second refrigerant circuit.

In each method previously described, the controller 404 thus analyzes HVAC system measurements 406 either independently or together with measurements from database 410. For example, if the controller 404 determines there is a refrigerant leak of the multi-circuit HVAC system 100, and that the location of the leak is only in the first refrigerant circuit, then the controller 404 may selectively turn off the compressor 150 of the first refrigerant circuit, while allowing the compressor 160 of the second refrigerant circuit to remain operational. Alternatively, the compressor 160 could be set to a partial-load mode. In this manner, the comfort within indoor space or environment conditioned by the multi-circuit HVAC system 100 could be less impacted as compared to fully shutting down both of the first and second refrigeration circuits of the multi-circuit HVAC system 100. In addition, the indoor blowers 118 could also continue to operate while the compressor 150 is selectively turned off. In this manner, a minimum air flow could be provided to occupants within the indoor space or environment, and the airflow could dilute concentrations of refrigerant which could accumulate in the indoor space or environment and in indoor section SP2 (FIGS. 1, 2A, 2B). Such dilution and maintaining of minimum air flow, while selectively turning off only the leaking refrigerant circuit of the multi-circuit HVAC system 100, may be helpful in complying with the safety regulations imposed for moderate-to-low GWP refrigerants, and mitigating the risks associated with occupant exposure to asphyxiation, fire, and explosion.

In addition to determining which of the first refrigerant circuit and the second refrigerant circuit is leaking, the controller 404 can also be programmed to determine a particular leak location along the instrumented circuit. Determining the leak location may be beneficial for technicians fixing the leaking refrigerant circuit, because the technicians will better know where to inspect for leaks and where to perform repairs. In addition, the particular leak location may also be used by the controller 404 when determining the control mode for the leaking refrigerant circuit. For example, a refrigerant leak detected along outdoor section SP1 may simply vent to the outdoor environment via the airflow of the outdoor fans 110, and thus may be treated differently than a leak detected along the indoor section SP2. When detecting a leak along the outdoor section SP1, the controller 404 could notify users to inspect and/or repair the multi-circuit HVAC system 100 and the leaking refrigerant circuit could maintain at least partial operation in a partial-load mode. For example, in the manner previously described, when the controller 404 compares the currently measured temperatures 414 and or pressures 416 of the first refrigerant circuit against the stored measurements in the database 410, the controller 404 can determine if the first refrigerant circuit is low on refrigerant and is thus potentially leaking. In this comparison, even if two sensors (for example sensors 202 and 208) where both at a lower temperature and/or pressure than the measurements in the database 410, the relative magnitude of the differences for each sensor 202, 208 could be used to determine the particular leak location. So in this example, if the sensor 202 measurement was 50% lower than the expected measurement in the database 410, while the sensor 208 was 20% lower than the expected measurement in the database 410, then the controller 404 could notify users that the leak location is along the refrigerant line 152 which includes the sensor 202.

The equipment of the refrigerant circuit, and thus flow of the refrigerant through the circuit may be controlled by a main controller (e.g., such as controller 500 of FIG. 5) that controls the multi-circuit HVAC system 100. The main controller may also be capable of communicating with a remote controller. A user can send, for example, set values for indoor temperatures of rooms in the indoor space being conditioned to the main controller from the remote controller.

The main controller performs at least on/off and partial-load control of the compressor 150, 160, on/off control of the outdoor fans 110, and on/off control of the indoor blowers 118. When any or all of the compressors 150, 160, the outdoor fans 110, and the indoor blowers 118 include a motor of a type whose speed is changeable, the main controller may be configured to control the speed of the motor or motors. In this case, the main controller can control the circulation amount of the refrigerant that flows through the refrigerant circuit by changing the operation of the motor of the compressors 150, 160. The main controller can change the flow rate of outdoor air that flows between the heat-transfer fins of the outdoor heat exchangers 154, 164 by changing the speed of the motor of the outdoor fans 110. The main controller can change the flow rate of indoor air that flows between the heat-transfer fins of the indoor heat exchanger 116 by changing the speed of the motor of the indoor blowers 118.

The main controller may be realized by, for example, a computer. The computer that constitutes the main controller includes a control calculation device and a storage device. For the control calculation device, a processor such as a CPU or a GPU may be used. The control calculation device reads a program that is stored in the storage device and performs a predetermined image processing operation and a computing processing operation in accordance with the program. Further, the control calculation device writes a calculated result to the storage device and reads information stored in the storage device in accordance with the program. However, the main controller may be formed by using an integrated circuit (IC) that can perform control similar to the control that is performed by using a CPU and a memory. Here, IC includes, for example, LSI (large-scale integrated circuit), ASIC (application-specific integrated circuit), a gate array, and FPGA (field programmable gate array).

Figure 5:
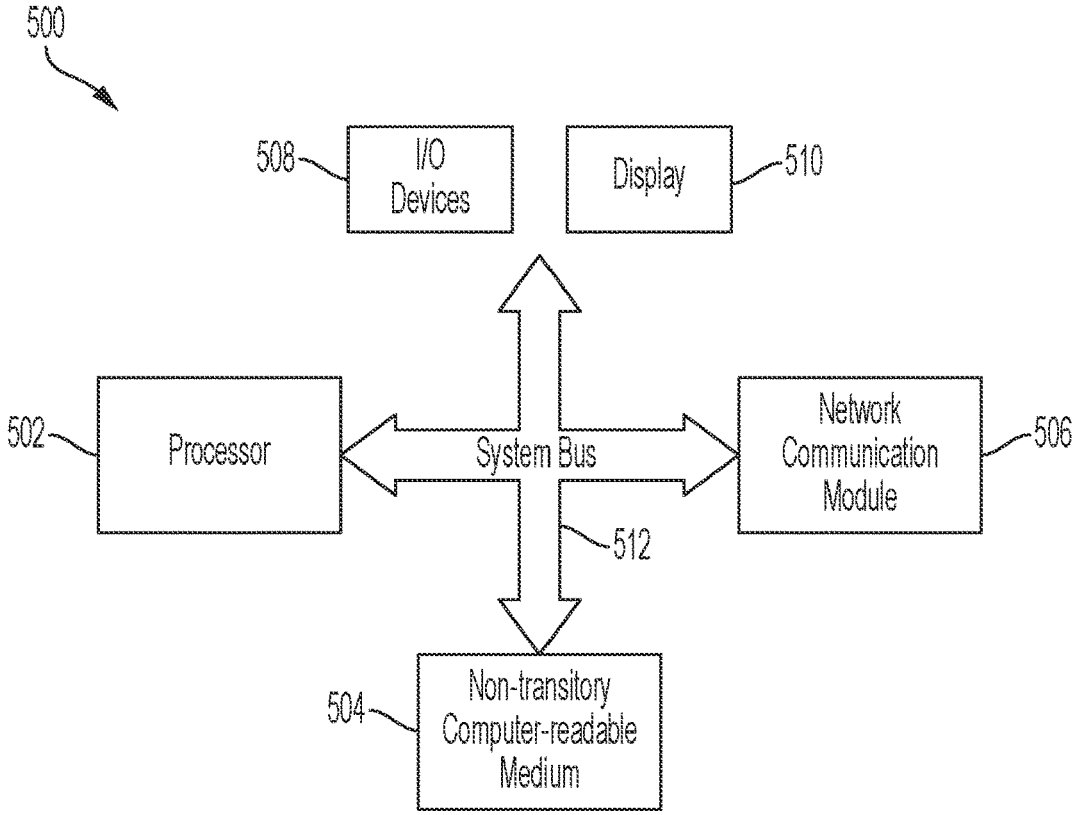
FIG. 5 is a block diagram of a controller, according to one or more embodiments.

FIG. 5 is a block diagram of a controller 500 that can be used to control the blower(s) and the compressor(s) of an HVAC system, such as in the control systems described above. The controller 500 includes at least one processor 502, a non-transitory computer readable medium 504, an optional network communication module 506, optional input/output devices 508, a data storage drive or device, and an optional display 510 all interconnected via a system bus 512. In at least one embodiment, the input/output device 508 and the display 510 may be combined into a single device, such as a touch-screen display. Software instructions executable by the processor 502 for implementing software instructions stored within the controller 500 in accordance with the illustrative embodiments described herein, may be stored in the non-transitory computer readable medium 504 or some other non-transitory computer-readable medium.

Should a leak of refrigerant be detected by a leak detection system such as the leak detection system 200 described above, the controller 500 is operable to selectively stop operation of at least one of the compressors 150, 160, while maintaining operation of the other compressor 150, 160 if no leak is detected on that refrigeration circuit. Further, the controller 500 may also activate output devices such as audible alarm and a visual alarm when the sensor detects a refrigerant leak. The alarms may be activated on the display 510, for example. The alarms may also be remote from the multi-circuit HVAC system 100 with the controller 500 communicating remotely with the alarms through a network connection.

The controller 500 may be realized by, for example, a computer. The computer that constitutes the controller 500 may include a control calculation device and a storage device. For the control calculation device, a processor such as a CPU or a GPU may be used. The control calculation device reads a program that is stored in the data storage device and performs a predetermined computing processing operation in accordance with the program. Further, the control calculation device writes a calculated result to the storage device and reads information stored in the storage device in accordance with the program. Alternatively, the controller 500 may be formed by using an integrated circuit (IC) that can perform control similar to the control that is performed by using a CPU. Here, IC includes, for example, LSI (large-scale integrated circuit), ASIC (application-specific integrated circuit), a gate array, and FPGA (field programmable gate array).

Although not explicitly shown in FIG. 5, it should be recognized that the controller 500 may be connected to one or more public and/or private networks via appropriate network connections. It will also be recognized that software instructions may also be loaded into the non-transitory computer readable medium 504 from an appropriate storage media or via wired or wireless means.

Certain terms are used throughout the description and claims to refer to particular features or components. As one skilled in the art will appreciate, different persons may refer to the same feature or component by different names. This document does not intend to distinguish between components or features that differ in name but not function.

For the embodiments and examples above, a non-transitory computer readable medium can comprise instructions stored thereon, which, when performed by a machine, cause the machine to perform operations, the operations comprising one or more features similar or identical to features of methods and techniques described above. The physical structures of such instructions may be operated on by one or more processors. A system to implement the described algorithm may also include an electronic apparatus and a communications unit. The system may also include a bus, where the bus provides electrical conductivity among the components of the system. The bus can include an address bus, a data bus, and a control bus, each independently configured. The bus can also use common conductive lines for providing one or more of address, data, or control, the use of which can be regulated by the one or more processors. The bus can be configured such that the components of the system can be distributed. The bus may also be arranged as part of a communication network allowing communication with control sites situated remotely from system.

In various embodiments of the system, peripheral devices such as displays, additional storage memory, and/or other control devices that may operate in conjunction with the one or more processors and/or the memory modules. The peripheral devices can be arranged to operate in conjunction with display unit(s) with instructions stored in the memory module to implement the user interface to manage the display of the anomalies. Such a user interface can be operated in conjunction with the communications unit and the bus. Various components of the system can be integrated such that processing identical to or similar to the processing schemes discussed with respect to various embodiments herein can be performed.

In some embodiments, the rotating equipment (e.g., motors) and valves disclosed herein are envisaged as being operable at specified speeds or variable speeds through inverter circuitry, for example. Moreover, the internal and external communication of the furnace may be accomplished through wired and or wireless communications, including known communication protocols, Wi-Fi, 802.11(x), Bluetooth, to name just a few.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A multi-circuit heating, ventilation, and air conditioning ("HVAC") system for use with a first refrigerant and a second refrigerant, the multi-circuit HVAC system comprising:

a first refrigerant circuit for the first refrigerant comprising a first compressor, a first outdoor heat exchanger, a first expansion valve, and a first indoor heat exchanger;

a second refrigerant circuit for the second refrigerant, the second refrigerant circuit being fluidically isolated from the first refrigerant circuit and comprising a second compressor, a second outdoor heat exchanger, a second expansion valve, and a second indoor heat exchanger;

at least one of a first sensor operable to detect a leak of refrigerant from both the first refrigerant circuit and the second refrigerant circuit or second sensors operable to measure at least one of temperature or pressure along the first refrigerant circuit and the second refrigerant circuit; and a controller in communication with a database including a stored set of operational values, wherein the controller is programmed to:

receive measurements from at least one of the first sensor or the second sensors;

compare the received measurements with the stored set of operational values and identify the refrigerant circuit or circuits that are leaking; and turn off operation of the leaking circuit or circuits, and if only one circuit is leaking, operate the other of the circuits.

2. The multi-circuit HVAC system of claim 1, further comprising a blower operable to move an air flow through at least one of the first indoor heat exchanger or the second indoor heat exchanger, wherein the controller is further programed to operate the blower if a leak is detected.

3. The multi-circuit HVAC system of claim 1, wherein the first sensor is a leak detector positioned to detect a leak from either of the first and second indoor heat exchangers.

4. The multi-circuit HVAC system of claim 1, further comprising:

both the first sensor and the second sensors; and wherein the first sensor is a leak detector positioned to detect a leak from either of the first and second indoor heat exchangers; and wherein the controller is further programmed to identify the leaking circuit or circuits based on measurements of the first sensor and the second sensors.

5. The multi-circuit HVAC system of claim 1, further comprising the second sensors and wherein the controller is further programmed to identify the leaking circuit based on measurements of the second sensors.

6. The multi-circuit HVAC system of claim 5, wherein the controller is programmed to determine a leak location along the leaking circuit.

7. The multi-circuit HVAC system of claim 1, wherein the stored set of operational values is at least one of averaged measured values from the second sensors or predicted operational values.

8. A method of operating a multi-circuit heating, ventilation, and air conditioning ("HVAC") system for use with a first refrigerant in a first refrigerant circuit and a second refrigerant in a second refrigerant circuit fluidically isolated from the first refrigerant circuit to condition an environment of a space, the method comprising:

receiving measurements from at least one of a first sensor or second sensors at a controller in communication with a database including a stored set of operational values;

identifying the refrigerant circuit or circuits experiencing a leak of refrigerant by comparing the received measurements with the stored set of operational values;

turning off operation of the leaking circuit or circuits using the controller; and if only one circuit is leaking, operating the other of the circuits using the controller.

9. The method of claim 8, further comprising operating a blower when the first sensor or the second sensors detect a leak to move an air flow through at least one of a first indoor heat exchanger or a second indoor heat exchanger.

10. The method of claim 8, wherein the first refrigerant circuit comprises a first indoor heat exchanger and the second refrigerant circuit comprises a second indoor heat exchanger, the method further comprising detecting a leak of refrigerant from either of the first and second indoor heat exchangers using the first sensor comprising a leak detector.

11. The method of claim 8, further comprising identifying, with the controller, the refrigerant circuit or circuits that are leaking based on the measurements of both the first sensor and the second sensors.

12. The method of claim 11, further comprising determining, with the controller, a leak location along the leaking circuit.

13. The method of claim 8, wherein the stored set of operational values is at least one of averaged measured values from the sensors or predicted operational values.

14. A controller for a multi-circuit heating, ventilation, and air-conditioning ("HVAC") system for use with a first refrigerant circuit and a second refrigerant circuit, wherein the multi-circuit HVAC system comprises at least one of a leak detector operable to detect a leak of refrigerant from both the first refrigerant circuit and the second refrigerant circuit or sensors operable to measure at least one of temperature or pressure along the first refrigerant circuit and the second refrigerant circuit, wherein the controller in communication with a database including a stored set of operational values is programmed to:

receive measurements from at least one of the leak detector or the sensors;

compare the received measurements with the stored set of operational values and identify the refrigerant circuit or circuits that are leaking; and turn off operation of the leaking circuit or circuits, and if only one circuit is leaking, operate the other of the circuits.

15. The controller of claim 14, wherein the controller is further programmed to operate a blower to move an air flow through at least one of a first indoor heat exchanger or a second indoor heat exchanger, if the leak is detected.

16. The controller of claim 14, wherein the first refrigerant circuit comprises a first indoor heat exchanger and the second refrigerant circuit comprises a second indoor heat exchanger and wherein the leak detector is positioned such that the leak detector is operable to detect the leak from either of the first and second indoor heat exchangers.

17. The controller of claim 14, wherein the multi-circuit HVAC system comprises the leak detector and the sensors and wherein the controller is further programmed to identify the leaking circuit based on measurements of the sensors.

18. The controller of claim 17, wherein the controller is programmed to determine a leak location along the leaking circuit.

19. The controller of claim 14, wherein the stored set of operational values is at least one of averaged measured values from the sensors or predicted operational values.

* * * * *